US006976715B2

(12) United States Patent
Lyon

(10) Patent No.: US 6,976,715 B2
(45) Date of Patent: Dec. 20, 2005

(54) MAGNETIC LATCH AND RELEASE APPARATUS

(75) Inventor: Donald J. Lyon, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 219 days.

(21) Appl. No.: 10/667,702

(22) Filed: Sep. 22, 2003

(65) Prior Publication Data

US 2005/0062296 A1 Mar. 24, 2005

(51) Int. Cl.[7] ..... E05C 17/56
(52) U.S. Cl. ..... 292/251.5; 292/300
(58) Field of Search ..... 292/341.15, 300, 292/251.5

(56) References Cited

U.S. PATENT DOCUMENTS 2,471,634 A * 5/1949 Vennice et al. ..... 49/395
3,790,197 A * 2/1974 Parker ..... 292/251.5
5,409,275 A * 4/1995 Yoshida et al. ..... 292/251.5
5,687,297 A 11/1997 Coonan et al. ..... 395/102
5,937,487 A * 8/1999 Bauer ..... 24/303
6,069,624 A 5/2000 Dash et al. ..... 345/333
6,607,223 B1 * 8/2003 Mastro ..... 292/251.5

FOREIGN PATENT DOCUMENTS

JP 09-236949 9/1997
JP 2002-265090 9/2002

* cited by examiner

*Primary Examiner*—Gary Estremsky
(74) *Attorney, Agent, or Firm*—Oliff & Berridge, PLC

(57) ABSTRACT

A magnetic latch mechanism and related process for easily and reliably performing a latch operation by moving a magnetically attractive catch plate into and out of engagement with a magnetic field. When in engagement, the latch is secured. When the catch plate is moved away from engagement, the latch can be opened. A magnetic latch for a marking system, particularly for panels covering paper path and jam clearance mechanisms.

28 Claims, 6 Drawing Sheets

MAGNETIC LATCH AND RELEASE APPARATUS

FIELD OF INVENTION

The field of the invention is a latch apparatus and more particularly a latch apparatus suitable for securing a movable member such as an enclosure panel with a magnetic latch and, when desired, providing an easy release mechanism from the magnetic latch.

BACKGROUND AND SUMMARY

Magnetic latches are commonly used to seal doors on cabinets, appliances, and other applications where openings and closings are frequent. A magnetic latch provides an inexpensive, durable, and simple latch device. One disadvantage of magnetic latches is the "stickiness" of the latch when attempting to first budge it from the closed position. The reason is that the magnetic force is greatest when the magnet or its strike plates are in direct contact with the metallic catch plate to which the magnet is attracted. The intensity of the magnetic field dissipates rapidly as the catch plate is moved from the magnet during the process of opening.

For a typical door, the above "stickiness" when freeing the catch plate from the magnet is a minimal problem since a person opening the door typically has ample room to grasp a handle and pull. When a person has only a small space within which to reach and grasp a handle, however, the "stickiness" of a magnetic latch can be problematic. Worse, when a person must reach under or around an apparatus in order to grasp a handle, the person may have very little leverage or room, and the 'stickiness" of the magnetic latch may require an awkward yank on the handle rather than a smooth and comfortable pull.

It would be advantageous to combine the inexpensiveness, durability, and simplicity of a magnetic latch with an easier method of freeing the catch plate from the magnet when opening the door. This advantage would be particularly desirable in those instances when a person has little room to reach a handle and must reach under or around encumbrances in order to exert force to open the door. Such a situation exists, for example, if the latch door opens downward within a small space that is lower than the level of an adult's comfortable reach.

One embodiment of the invention is a magnetic latch mechanism for removably latching a first member to a second member, comprising: a magnet emitting a magnetic field mounted to the first member; and a magnetically attractive catch plate mounted to the second member; wherein, prior to moving one member in relation to the other member, the position of the catch plate is moved in relation to the position of the magnet from a position strongly engaged with the magnetic field to a position weakly engaged with the magnetic field.

Another embodiment of the invention is a marking device, comprising: an enclosure panel for covering a space; a frame member proximate to an edge of the space; a magnet emitting a magnetic field mounted to the frame member; and a magnetically attractive catch plate mounted to the enclosure panel; wherein, prior to moving the enclosure panel covering the space, the position of the catch plate is moved in relation to the position of the magnet from a position strongly engaged with the magnetic field to a position weakly engaged with the magnetic field.

A process for unlatching one member from a second member, comprising: mounting a magnet emitting a magnetic field to the first member; mounting a magnetically attractive catch plate to the second member; prior to changing the position of one member in relation to the other, moving the position of the catch plate in relation to the position of the magnet from a position strongly engaged with the magnetic field to a position weakly engaged with the magnetic field; and changing the position of the first member in relation to the second member.

DETAILED DESCRIPTION

Figure 1:
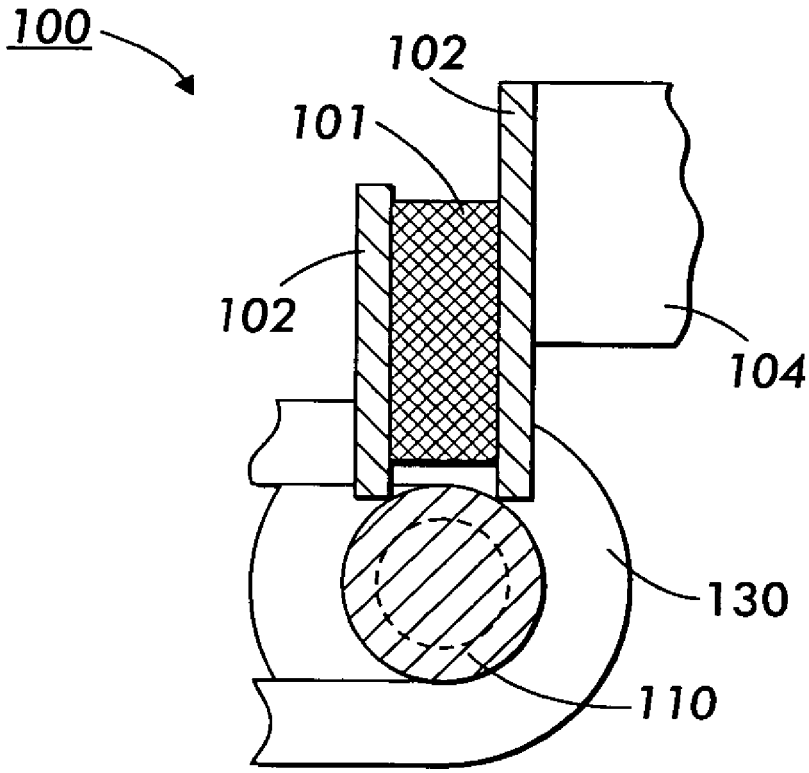
FIG. 1 is an elevated cross-sectional view of an embodiment of the invention.

For a general understanding of the present invention, reference is made to the drawings. In the drawings, like reference numerals have been used throughout to designate identical elements.

Referring first to FIG. 1, a schematic cross sectional view is shown of one embodiment 100 of the invention. In this view, magnet 101 is shown with twin strike plates 102. Strike plates 102 can be of any metallic or other material through which a magnetic field can be transmitted. Magnet 101 and strike plates 102 are mounted to an enclosure body by attachment to support member 104. Support member 104 may be part of the enclosure that moves during opening or may be part of the enclosure body, and rod 110 may similarly be positioned opposite support member 104 on either the door or the enclosure body. Support bracket 130 is shown wrapping around rod 110 in order to slidably mount rod 110 in the panel or other member to be latched to member 104.

The magnet and strike plate assembly is positioned such that in the door's closed position, at least one of the strike plates is in close proximity to bar or rod 110, preferably touching. The cross section of rod 110 is shown in FIG. 1 as a circular bar but may have any cross-sectional shape, including a square or rectangular shape. In this embodiment of the invention, rod 110 serves as the catch plate. As such, rod 110 in this embodiment should be of a suitable magnetically attractive material such as iron or steel.

Figure 2:
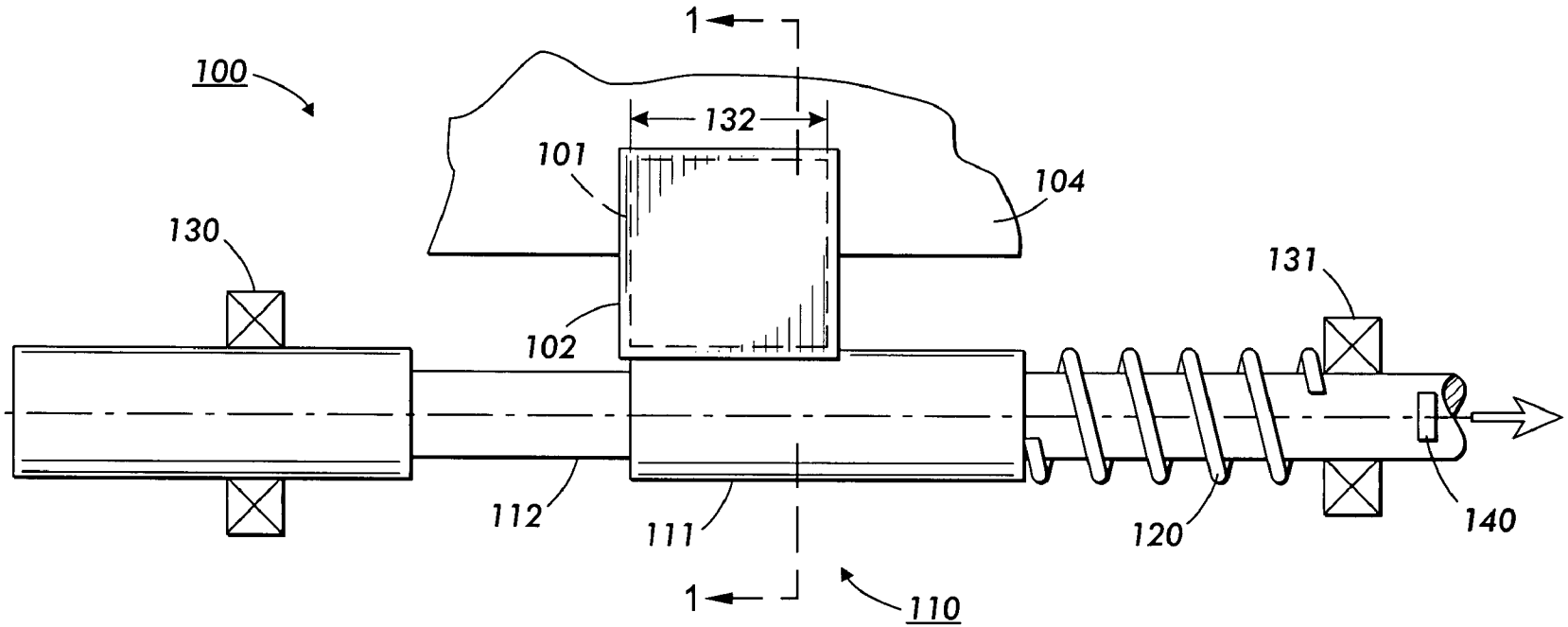
FIG. 2 is a plan view of the embodiment of the present invention shown in FIG. 1 wherein the catch plate is in an engaged position.

Referring next to FIG. 2, a plan schematic view of latch system 100 is shown. In this view, magnet 101 and strike plate 102 are shown suspended from support member 104 and in contact with rod 110. This configuration conforms to the configuration shown in FIG. 1. Additional features shown in FIG. 2 include subparts of rod 110. Specifically, section 111 of rod 110 is dimensioned to be in intimate proximity or contact to strike plates 102 when in latched position. In the embodiment shown, section 111 is the full diameter of rod 110. In contrast, section 112 has been turned or otherwise machined or formed to be less than the diameter of section 111. Although in this embodiment, section 112 is also comprised of a magnetically attractive material, its diameter is such that if moved laterally underneath strike plates 102, the surface of section 112 would be sufficiently removed from strike plates 102 that the force of attraction would be extremely small.

Other elements shown in FIG. 2 include a compression spring 120 for biasing or urging rod 110 into the position shown in FIG. 2 in which section 111 is in contact with strike plates 102. Also, retaining brackets 130 and 131 are shown in cross-section. In this embodiment, these brackets loop around rod 110 to hold it to the enclosure door or other member to be retained in position when strike plates 102 are in close proximity to section 111 of rod 110. As shown in the perspective of FIG. 2, brackets 130 and 131 allow rod 110 to slide side-to-side along the magnet's length axis marked 132 but not up and down. Biasing spring 120 urges rod 110 toward the left in FIG. 2. To counteract biasing spring 120, a force exertion member such as lever 140 is provided. Lever 140 can be any protrusion that enables fingers or machine parts to exert a force to the right, opposing and overcoming the biasing force of spring 120. Instead of a lever such as 140, force may also be employed by pushing or pulling other parts of rod 110, including using the end regions of rod 110 as force exertion members for pushing or pulling of the rod.

Figure 3:
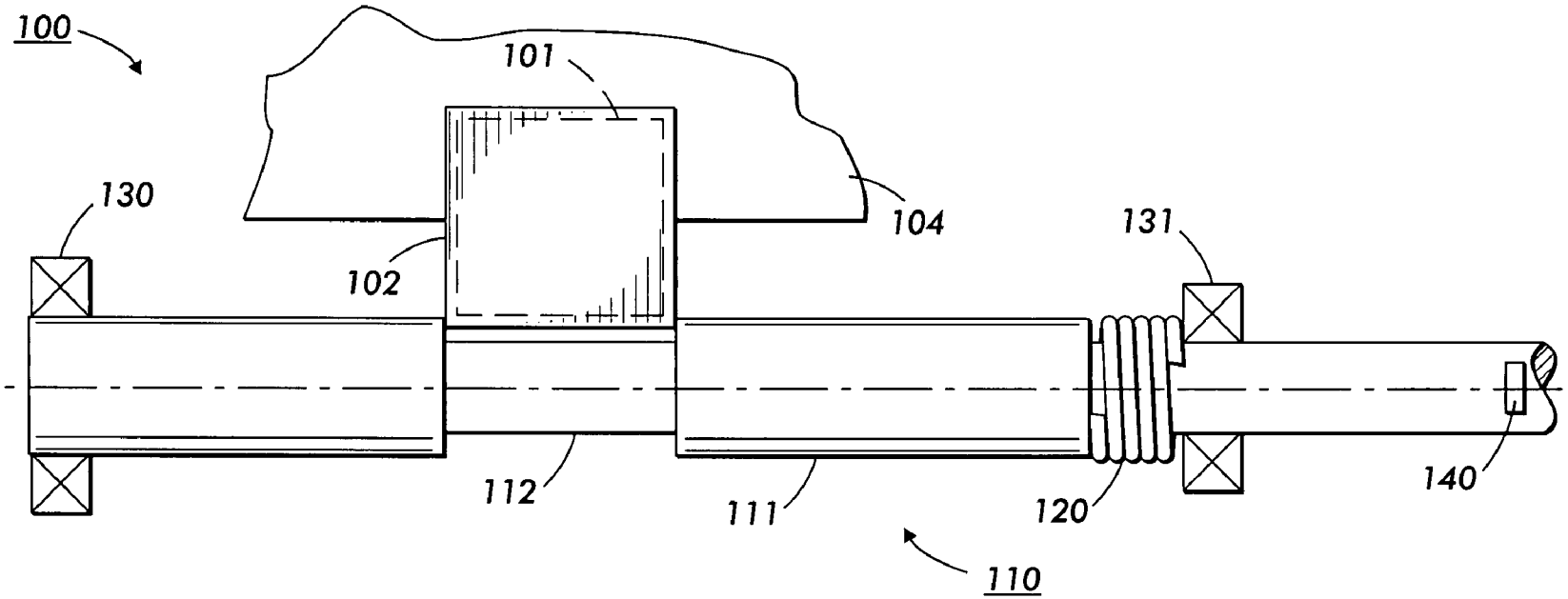
FIG. 3 is a plan view of the embodiment of the invention shown in FIG. 1 wherein the catch plate is in a disengaged position.

FIG. 3 shows the state of the latch system once a force has been exerted to push rod 110 to the right. In this state, spring 120 has been compressed, and section 112 has been moved underneath strike plates 102. The result is that close proximity between rod 110 and strike plates 102 has been lost. Negligible magnetic attraction force will be exerted upon rod 110, thereby effectively "unlatching" rod 110 from housing 104. If rod 110 is attached to a door or other member hung from the bottom of an enclosure, then such door or member is expected to move to its unlatched position. Similarly, if rod 110 is attached to a door or other member that is mounted essentially vertically, then release of latch mechanism 100 allows a pulling or other force to easily move the door or member to its open or removed unlatched position.

Figure 4:
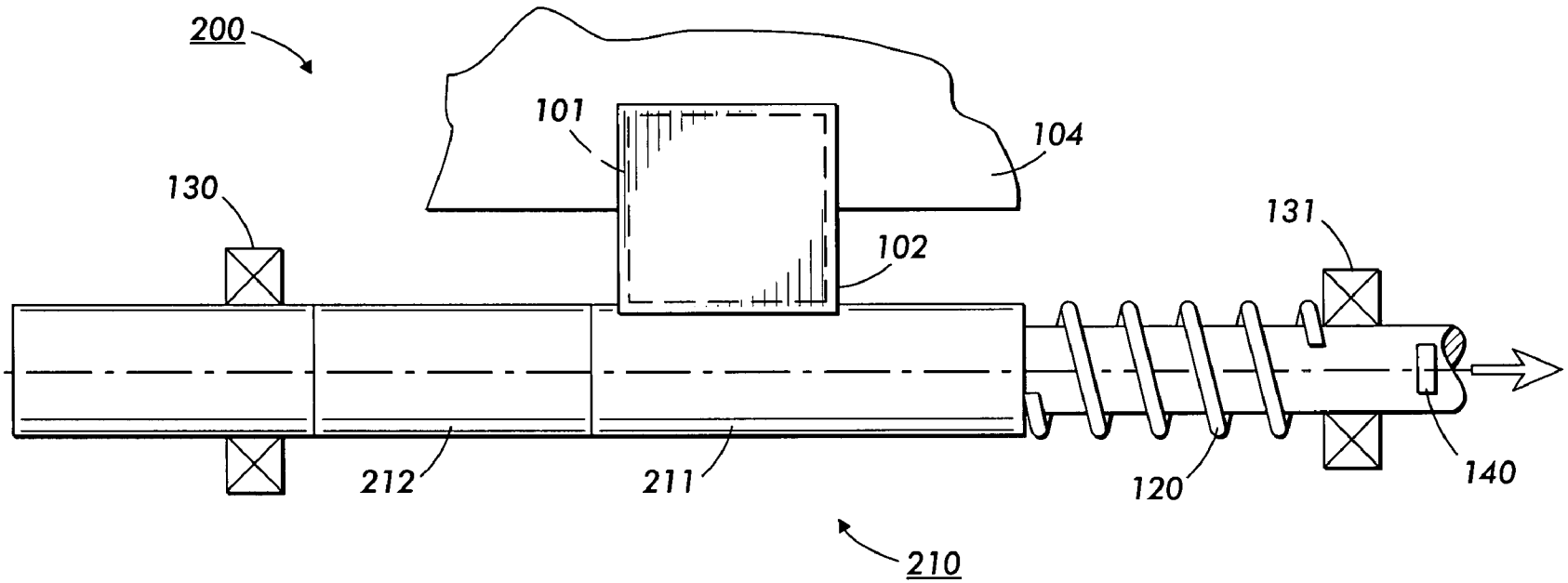
FIG. 4 is a plan view of another embodiment of the invention in which a rod comprises both magnetic and non-magnetic sections.

Referring to FIG. 4, another embodiment of latch mechanism is shown. In this embodiment, rod 210 is the same diameter throughout its length. However, section 212 is made of a non-magnetic material such as plastic. The result is the same as the mechanism shown in FIGS. 2 and 3.

Figure 5:
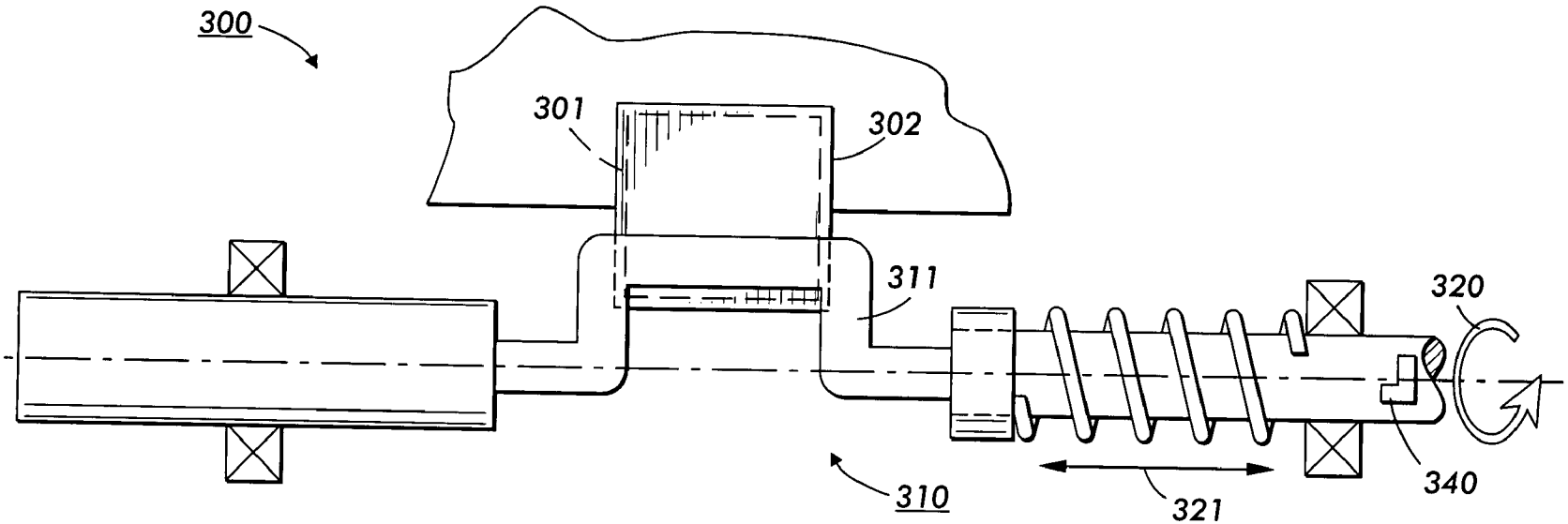
FIG. 5 is a plan view of yet another embodiment of the invention comprising a curved rod.

Referring to FIG. 5, yet another of many possible embodiments is shown. In this embodiment 300, rod 310 contains a U-shaped section 311. When rotated appropriately, magnetically attractive section 311 becomes latched by contact with strike plates 302. Instead of being pushed laterally, rod 310 operates as a latch by being rotated around its axis as shown by arrow 320. The results are similar to those shown in FIGS. 2 and 3. Alternatively, rod 310 can be slidably mounted for movement along arrow 321, in which case this embodiment will operate similarly to the embodiment shown in FIGS. 1 and 2. A square shaped rod may be particularly appropriate for a latch configured as shown in FIG. 5.

Figure 6:
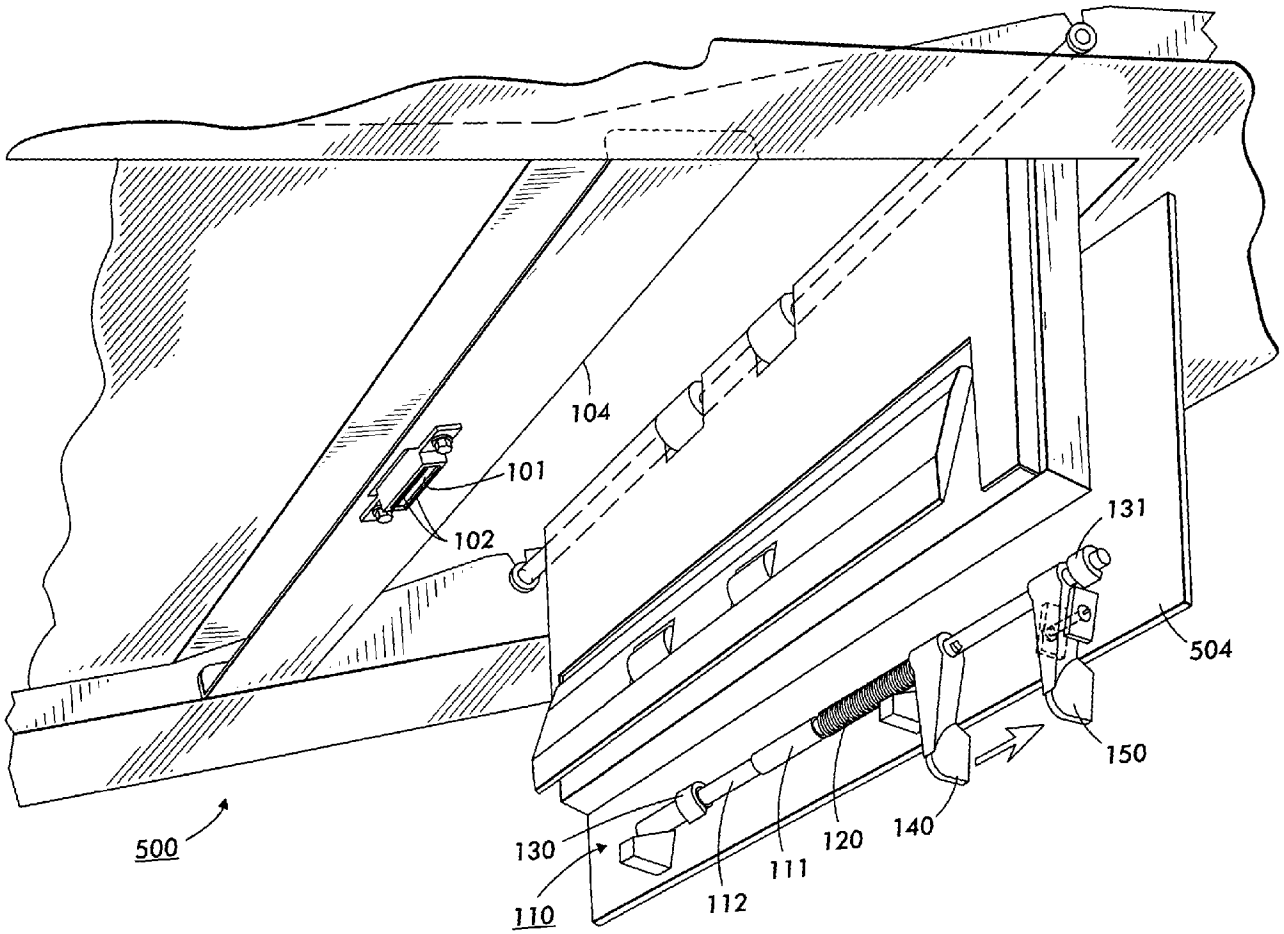
FIG. 6 is an elevated perspective view of an embodiment of the invention as used to latch a panel enclosure covering access mechanisms in which substrates may be jammed.

Referring to FIG. 6, application of an exemplary embodiment of the invention is shown as part of a jam clearing mechanism for a document feeder ("DF") mounted on top of an electrostatographic imaging system. Such imaging systems are well known in the art. One electrostatographic imaging process is electrophotography. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Referring again to FIG. 6, the latch mechanism of FIGS. 2 and 3 is shown as a latch that holds a jam clearance panel door 504 "up" against the bottom of DF body 500 during normal operations. DF 500 may take many forms, including without limitation, recirculating document feeders and simultaneous duplex document feeders. In the DF of FIG. 5, latch mechanism 100 is labeled as in FIGS. 2 and 3. In addition to lever 140 that is attached to rod 110, a gripping fixture in the form of lever 150 is included. Lever 150 is fixedly attached to door 504 and is spaced apart from lever 140 at a distance that is conveniently spanned by a human hand. The result is that when DF 500 is lifted by its rear hinge (not shown) from the printer platen, an operator may reach under the body of DF 500 to grip levers 140 and 150 between thumb and index finger. By squeezing the hand, lever 140 with its attached rod 110 is moved from the position shown in FIG. 2 to the position shown in FIG. 3. As discussed in relation to those figures, such shift moves section 112 of rod 110 underneath strike plates 102, and the magnetic force holding door 504 in place snug against the body of DF 500 is released. As a result, door 504 is free to swing down from its hinge (not shown). The operator can then clear paper from the slot and mechanism exposed beneath door 504. When cleared, the operator can lift door 504 back into its latched position. As soon as the operator released pressure from levers 140 and 150, bias spring 120 shifted rod 110 back into the configuration shown in FIG. 2.

The result is that when door 504 is lifted to its latched position, section 111 of rod 110 is one again in close proximity to strike plates 102, and the door is latched in place.

In sum, the latch mechanism of the invention may have many embodiments. By using a magnet and a movable catch plate, the mechanism provides for a reliable, durable, inexpensive latch system that requires minimal force to open while virtually eliminating the "stickiness" of prying a catch plate away from a magnet. This amelioration of "stickiness" is particularly advantageous when, as shown in FIG. 6, the latch must be operated under conditions that constrain an operator's ability to apply ample force or that require handling in a confined space.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A magnetic latch mechanism for removably latching a first member to a second member, comprising:

a magnet emitting a magnetic field mounted to the first member; and a magnetically attractive catch plate mounted to the second member, wherein, prior to moving one member in relation to the other member, the position of the catch plate is moved in relation to the position of the magnet from a position strongly engaged with the magnetic field to a position weakly engaged with the magnetic field, wherein the catch plate includes a rod, the rod having a first section and a second section, each of the first section and the second section having a diameter of a cross section taken perpendicular to direction of elongation, the diameter of the first section being larger than the diameter of the second section.

2. The mechanism of claim 1, wherein the magnet is fixedly mounted to the first member and wherein the catch plate is movably mounted to the second member.

3. The mechanism of claim 1, further comprising at least one strike plate in intimate proximity to the magnet wherein the magnetic field is transmitted through the strike plate.

4. The mechanism of claim 1, wherein the magnet has an operative length dimension and wherein the position of the catch plate is moved in relation to the position of the magnet along the length dimension from a position strongly engaged with the magnetic field to a position weakly engaged with the magnetic field.

5. The mechanism of claim 1, wherein the first section strongly engages the magnetic field when located in a first position proximate to the magnet; and the second section weakly engages the magnetic field when moved to the first position.

6. The mechanism of claim 5, wherein the rod is straight.

7. The mechanism of claim 5, wherein the rod is curved.

8. The mechanism of claim 5, wherein the rod has a section comprised of strongly magnetically attractive material and a section comprised of material that is weakly influenced by a magnetic field.

9. The mechanism of claim 5, wherein the rod is slidably mounted.

10. The mechanism of claim 5, wherein the strongly engaged section of the rod has material positioned closer to the magnet than material in the weakly engaged section.

11. The mechanism of claim 10, wherein the weakly engaged section of the rod is comprised of a section with material removed from the rod.

12. The mechanism of claim 1, further comprising a biasing device for urging the latch mechanism into the position in which the magnetic field is strongly engaged.

13. The mechanism of claim 12, wherein the biasing device is a spring.

14. The mechanism of claim 1, further comprising a force exertion member fixed to the rod.

15. The mechanism of claim 14, wherein the force exertion member is a protrusion from the rod.

16. The mechanism of claim 14, further comprising a gripping fixture, fixedly located proximate to the force exertion member, for applying force between the gripping fixture and the force exertion member in order to move the force exertion member towards the gripping fixture.

17. A marking device, comprising:

an enclosure panel for covering a space;

a frame member proximate to an edge of the space;

a magnet emitting a magnetic field mounted to the frame member; and a magnetically attractive catch plate mounted to the enclosure panel;

wherein, prior to moving the enclosure panel covering the space, the position of the catch plate is moved in relation to the position of the magnet from a position strongly engaged with the magnetic field to a position weakly engaged with the magnetic field, wherein the catch plate includes a rod slidably mounted to the enclosure plate, the rod having a first section and a second section, each of the first section and the second section having a diameter of a cross section taken perpendicular to direction of elongation, the diameter of the first section being larger than the diameter of the second section.

18. The marking device of claim 17, wherein the rod comprises:

a first section that strongly engages the magnetic field when located in a first position proximate to the magnet; and a second section that weakly engages the magnetic field when moved to the first position.

19. The marking device of claim 17, further comprising a biasing device for urging the catch plate towards the strongly engaged position.

20. The marking device of claim 17, wherein the device is an electrophotograhic imaging device.

21. The marking device of claim 17, further comprising a document feeder subsystem comprising the magnet and the catch plate.

22. The marking device of claim 21, wherein moving the enclosure panel exposes access to mechanisms in which substrates may be jammed.

23. A process for unlatching one member from a second member, comprising:

mounting a magnet emitting a magnetic field to the first member;

mounting a magnetically attractive catch plate to the second member;

prior to changing the position of one member in relation to the other, moving the position of the catch plate in relation to the position of the magnet from a position strongly engaged with the magnetic field to a position weakly engaged with the magnetic field; and changing the position of the first member in relation to the second member, wherein the catch plate includes a rod slidably mounted to the enclosure plate, the rod having a first section and a second section, each of the first section and the second section having a diameter of a cross section taken perpendicular to direction of elongation, the diameter of the first section being larger than the diameter of the second section.

24. The process of claim 23, further comprising:

sliding the rod from a position in which the rod is strongly engaged with the magnetic field to a position in which the rod is weakly engaged with the magnetic field.

25. The process of claim 24, wherein the first section strongly engages the magnetic field when located in a position proximate to the magnet and the second section that weakly engages the magnetic field when moved to a position proximate to the magnet; and sliding the rod from a strongly engaged position to a weakly engaged position comprises sliding the rod from a position in which the first section is proximate to the magnet to position in which the second section is proximate to the magnet.

26. The process of claim 24, further comprising:

biasing the rod with a device that urges the catch plate towards the strongly engaged position.

27. The process of claim 24, further comprising:

exerting pressure against a force exertion member fixed to the rod in order to move the position of the catch plate in relation to the magnet.

28. The process of claim 27, wherein exerting further comprises applying force between the force exertion member and a gripping fixture fixedly located proximate to the force exertion member.

* * * * *